United States Patent [19]

Sinclair

[11] Patent Number: 4,753,436

[45] Date of Patent: Jun. 28, 1988

[54] CAROUSEL MECHANISM

[76] Inventor: Josephine B. Sinclair, 226 Raleigh Ave., Hampton, Va. 23661

[21] Appl. No.: 80,101

[22] Filed: Jul. 31, 1987

[51] Int. Cl.[4] ..... A63H 13/20

[52] U.S. Cl. ..... 272/31 R; 272/42; 272/44; 272/45; 272/47; 446/238

[58] Field of Search ..... 272/31 R, 33, 37, 42, 272/47, 31 A, 31 B, 31 P, 28 R, 28 S, 44, 36, 38–41; 446/237, 238, 409

[56] References Cited

U.S. PATENT DOCUMENTS

| | | | |
|---|---|---|---|
| D. 92,046 | 4/1934 | Steiner . | |
| 843,406 | 2/1907 | Mangels . | |
| 889,729 | 6/1908 | Slater | 446/238 |
| 1,058,881 | 4/1913 | Matushak | 446/238 |
| 1,167,650 | 1/1916 | Nachtigall . | |
| 1,179,232 | 4/1916 | Shewan . | |
| 1,395,175 | 10/1921 | Chinn . | |
| 1,531,500 | 3/1925 | Pickett . | |
| 1,566,479 | 12/1925 | Horvath et al. | 272/31 R X |
| 2,657,928 | 11/1953 | McDonald . | |
| 2,846,223 | 8/1958 | Nelson | 272/31 R |
| 2,999,335 | 9/1961 | Barnett | 272/31 R X |
| 3,187,461 | 6/1965 | Vicini | 446/238 |
| 3,191,930 | 6/1965 | Cottrell et al. . | |
| 3,279,793 | 10/1966 | Lakin | 272/31 R |
| 3,297,319 | 1/1967 | Chereau . | |
| 3,356,365 | 12/1967 | DeShano . | |
| 3,498,603 | 3/1970 | Lakin | 272/31 R |
| 3,898,054 | 7/1975 | Riggs . | |
| 4,365,819 | 12/1982 | Bart | 272/31 R X |

FOREIGN PATENT DOCUMENTS

| | | | |
|---|---|---|---|
| 2441399 | 7/1980 | France | 272/31 R |

*Primary Examiner*—Carl D. Friedman
*Assistant Examiner*—Richard E. Chilcot, Jr.
*Attorney, Agent, or Firm*—Wallace J. Nelson

[57] ABSTRACT

A carousel mechanism 10 is disclosed and includes a housing 11, a fixed support disk 17 attached to the housing and having a hollow vertical shaft 19 attached to and extending therethrough. A drum 21 is disposed around vertical shaft 19 and fixed to the support disk 17. A spool member 22, having a pair of spaced disk ends 23, 25 and a central hub 27 is rotatably disposed on the vertical shaft 19 and has one end thereof supported by drum 21. A plurality of carousel figurines 50 are disposed within spool 22 with individual vertical support rods 52 therefor slidably extending through both ends of the spoon 22. An undulating track, formed of arcurate elements 64 and the surface of fixed support disk 17, serves to provide a route for wheels 62 carried on the ends of sliding support rods 52 to give a reciprocating vertical movement to figurines 50 as spool 22 rotates.

A multi-colored translucent canopy 29 is rotatably disposed on hollow vertical shaft 19 in spaced relationship with the top spool end and a mechanism (hub 30, elongated rod elements 36 and wheels 38) serves to impart reverse rotation to canopy 29 as spool 22 rotates. Lights 40 and 41 illuminate the figurines and canopy with a single switch S actuating the lights, a carousel music box 14 and a drive motor M for rotating the spool member 22.

Figurines 50, the individual panels 34 of canopy 29 and pickets 43 circumscribing carousel 10 are all formed of translucent stained glass.

20 Claims, 2 Drawing Sheets

CAROUSEL MECHANISM

BACKGROUND OF THE INVENTION

This invention relates to carousel mechanisms in general and relates, in particular, to a carousel mechanism useful in displays, commercial advertising and for the general amusement and entertainment of children and adults.

The invention is primarily directed toward miniature or toy carousel structures but some of the novel features thereof may be incorporated into full size carousels.

Numerous carousel mechanisms are known in the prior art; some utilizing drive motors mounted on the top of the rotating unit, with others having the driving motor positioned beneath the rotating unit. Both direct gear drive and pulley drives have been employed. Also, various systems have been utilized for providing vertical reciprocating movement to the carousel figurines, and for providing attractive lights and music to the rotating figures. Each of these prior art mechanisms has advantages and disadvantages.

One of the objects of the present invention is to provide a new and novel carousel mechanism that incorporates the advantageous features of the prior art carousel mechanisms while minimizing the disadvantages thereof.

It is a further object of the present invention to provide an improved carousel mechanism.

It is another object of the present invention to provide a carousel mechanism that is attractive to the observer and simple in construction.

It is a further object of the present invention to provide a carousel mechanism that has portions rotating in a clockwise direction and portions thereof rotating in a counterclockwise direction.

A further object of the present invention is a carousel provided with figurines thereon that promote a specific advertising theme.

Another object of the present invention is a carousel mechanism that permits the figurines thereon to be easily changed to provide different display themes.

SUMMARY OF THE INVENTION

According to one aspect of the present invention the foregoing and additional objects are attained by providing a support structure having a fixed support disk mounted thereon, a hollow vertical shaft extending through, and fixed to the support disk, and a drum of smaller diameter than the support disk disposed around the vertical shaft and fixed to the support disk. A spool member, having a pair of spaced disk ends attached to a central elongated hub, is rotatably disposed on the vertical shaft and has one end thereof supported by the drum. A plurality of carousel figurines are circumferentially disposed within the spool with individual vertical support rods therefor slidably extending through both the spool ends.

An undulating track is provided on the surface of the fixed support disk. Wheels are disposed on one end of the figurine support rods to traverse the undulating track as the spool rotates and impart individual vertical reciprocating movement to the figurines. A multi-colored translucent canopy is rotatably disposed on the hollow vertical shaft in spaced relationship with the top spool end and a mechanism is provided between the canopy and spool to impart reverse rotation to the canopy as the spool rotates. Lights are provided beneath the canopy to illuminate the figurines and canopy. A single switch leading to a suitable power source actuates the lights, a carousel music box and a drive motor for rotating the spool member.

BRIEF DESCRIPTION OF THE DRAWINGS

A more complete appreciation of the invention and many of the attendant advantages thereof will be readily apparent as the same becomes better understood by reference to the following detailed description when considered in connection with the accompanying drawings wherein.

DETAILED DESCRIPTION

Figure 1:
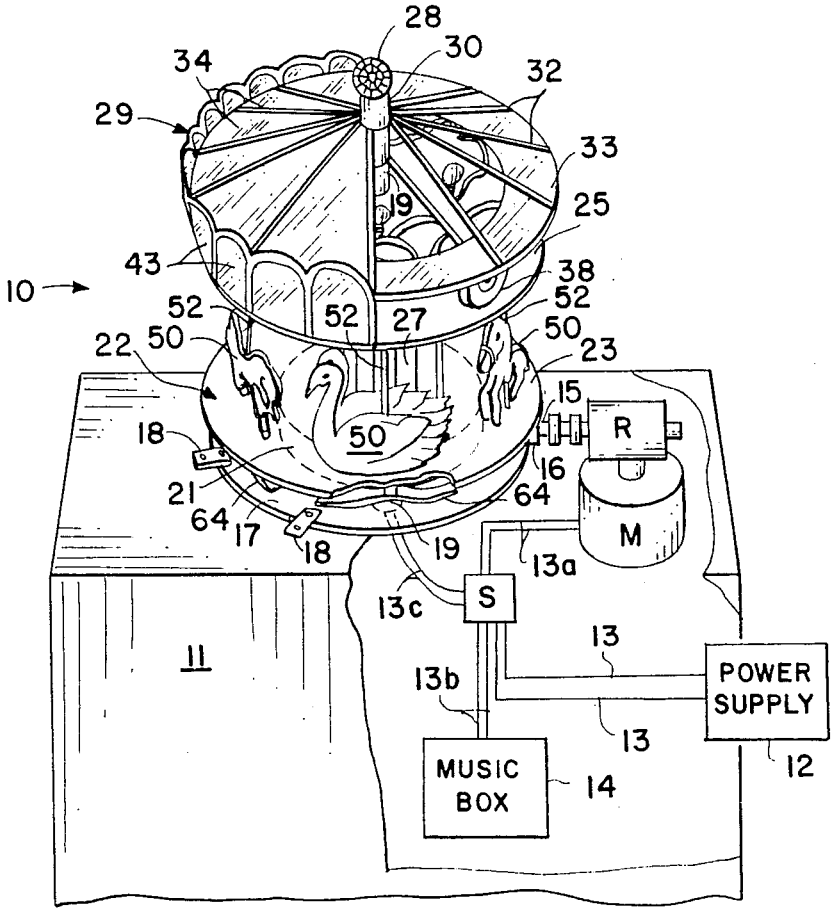
FIG. 1 is a part sectional, part schematic, view of the carousel mechanism and support structure of the present invention, with parts broken away.
Figure 2:
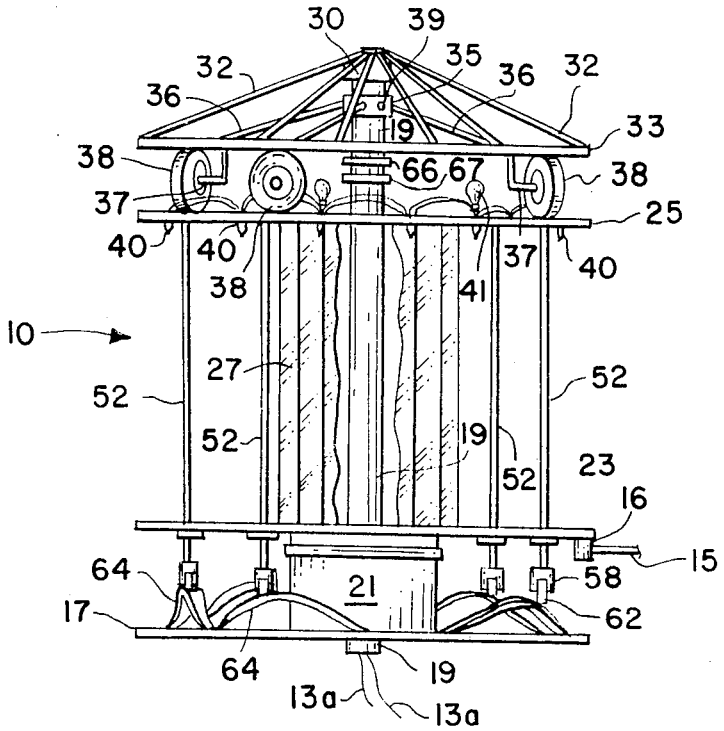
FIG. 2 is a view similar to FIG. 1, with parts omitted for clarity, illustrating the undulating track and the mechanism for causing reverse rotation of the canopy as the carousel figurines rotate.

Referring now to the drawings and more particularly to FIGS. 1 and 2, the carousel mechanism of the present invention is designated generally by the reference numeral 10 and is supported by a support cabinet 11. A suitable power supply 12 is connected to a switch S via wires 13. Switch S is in electrical connection with motor M, music box 14 and to a plurality of lights (as will be further explained hereinafter) through respective wire pairs 13*a*, 13*b*, and 13*c*. Motor M is provided with a reduction gear R having a drive shaft 15 extending therefrom. A drive wheel 16, secured to the end of drive shaft 15, is in frictional contact with rotatable portions of the carousel to act as the drive mechanism therefor, as will be further explained hereinafter. Carousel 10 includes a support disk 17 bolted or otherwise conventionally attached to cabinet 11 via a plurality of brackets 18.

A hollow vertical shaft 19 is secured to and extends through support disk 17. A drum 21 is attached to support disk 17 about vertical shaft 19. A spool member, designated by arrow 22, and having a pair of annular plates or disk ends 23, 25 and a central elongated hub 27, is rotatably supported by drum 21. A substantially conical multi-colored canopy, designated by arrow 29, is rotatably disposed on vertical shaft 19 in spaced relationship with spool 22. A reflective multi-faceted ball 28 is fixedly secured to the apex of canopy 29 so as to rotate therewith. Ball 28 is formed of a plurality of individual mirror segments adhered to a substantially spherical surface. Canopy 29 is secured to a first conical frame formed of a central hub 30 and a plurality of elongated flat supports 32 that terminate in fixed attachment to an annular ring 33. Individual, essentially triangular, translucent stained glass panels 34 are supported by and secured to the elongated flat supports 32 and annular ring 33, as will be further explained hereinafter. Annular ring 33 is disposed in parallel spaced relationship to disk 25 on spool 22.

A second conical frame is disposed between canopy 29 and disk 25 and includes a hub 35 fixed, via set screw 39 (FIG. 2), to vertical shaft 19. Fixed hub 35 is adjacent to rotatable hub 30, and is provided with a plurality of attached, depending, elongated rod elements 36. The other end of elongated rod elements 36 are bent to form an axle 37 between, and parallel with, annular ring 33 and disk 25. A wheel having a rubber tire mounted thereon is disposed on each axle, as designated by reference numeral 38.

A plurality of electric lights are disposed on disk 25 with some of the lights extending therethrough, and as designated by reference numeral 40. Some of the lights are disposed in the space between annular ring 33 and disk 25, as designated by reference numeral 41. Lights 40 serve to illuminate the spool area between disks 23 and 25, while lights 41 are directed beneath canopy 29. Electric power for lights 40 and 41 is supplied through wires 13c extending through vertical shaft 19 and leading to a slip ring connector, as will be further explained hereinafter.

A plurality of picket members 43 (FIG. 1) are secured to canopy 29 about the periphery of annular ring 33. Picket members 43 are of adequate height to span, and shield from view, the spaced area between annular ring 33 and disk 25 of spool 22. Some of the picket members are formed of translucent stained glass and some of mirrored surfaces, as will be further explained hereinafter.

A plurality of carousel figurines, designated by reference numberal 50, are circumferentially disposed about the vertically extending elongated hub 27 of spool 22. Each figurine is releasably attached to a vertical rod member 52 through solder connections, or the like. Hub 27 is provided with a multi-faceted mirror surface formed of a plurality of longitudinal thin mirror strips disposed in abutting circumferential relationship.

Figure 3:
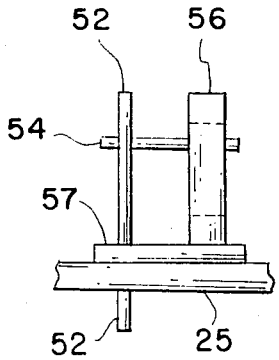
FIG. 3 is an enlarged view of one of the vertical rod support ends illustrating the structure for preventing rod rotation during vertical movement thereof.
Figure 4:
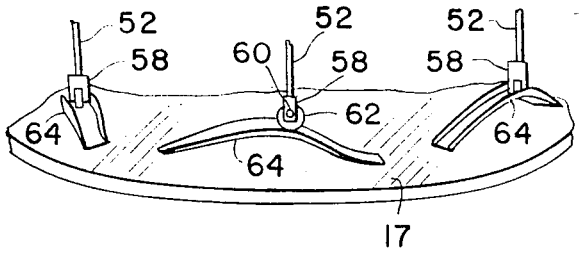
FIG. 4 is an enlarged view of the other end of one of the vertical rod support ends illustrating the structure that traverses the undulating track and showing part of the undulating track; and, FIG. 5 is an enlarged partial view of the electric light connections employed in the present invention.

Referring to FIGS. 3 and 4 the details of an individual rod support 52 will now be described. The top of each rod 52 extends through disk 25, as described hereinbefore. A detent pin is removably and transversly fixed through the diameter of rod 52 and is received by a channeled bracket 56. Bracket 56 is bolted or otherwise conventionally secured to disk 25, through fixture 57, so as to remain in a fixed upright position as shown in FIG. 3. Fixture 57 serves as a bushing for support rod 52 and as a support for bracket 56. The channel of bracket 56 extends therethrough and is of adequate width to slidably receive detent pin 54. The length of the channel is sufficient to permit support rod 52, attached to detent pin 54, to undergo vertical reciprocating movement, while preventing relative rotation of support rod 52.

The bottom of each support rod 52 (FIG. 4) terminates in a bifurcated axle support 58 having an axle 60 extending therethrough. A rubber tired wheel 62 is rotatably supported on axle 60 and is adapted to traverse an undulating track on disk 23. The undulating track is formed by disk 23 and a plurality of arcurate shaped track elements 64 disposed in circumferentially spaced relationship about disk 23. As spool 22 rotates, it carries support rods 52 with wheels 62 traversing track elements 64. As the wheels 62 start the incline of arcurate element 64, rod 52 and attached figurine 50 start an upward vertical movement. When wheel 62 starts its descent along arcurate element 64, rod 52 and attached figurine 50 start a downward vertical movement. The space between arcurate elements 64 permits figurines 50 and support rod 52 to remain in its lowest position while wheel 62 rotates along the surface of disk 23, and the vertical reciprocating movement is repeated as the next arcurate element 64 is encountered.

Figure 5:
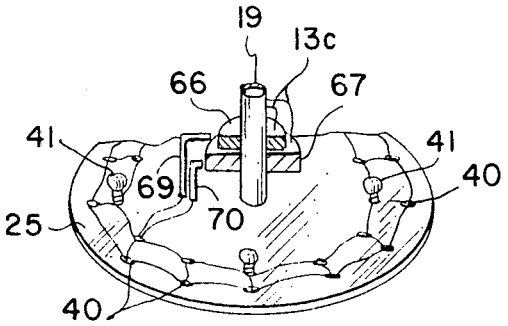

Referring now to FIG. 5 the details of the power connection from wires 13c leading from switch S will now be described. Wires 13c extend from switch S, through hollow vertical shaft 19 to an opening therein, where they connect with a pair of collector or slip rings 66 and 67 fixed to shaft 19. A pair of flexible sliding contacts 69 and 70 are fixed to rotating disk 25 and are disposed in sliding contact with slip rings 66 and 67. The flexible contacts 69 and 70 are connected to the series of lights 40 and 41 and serve to transfer power from wires 13c to these lights via slip ring collectors 66 and 67, as disk 25 rotates.

Referring again to FIGS. 1 and 2, the multi-colored canopy 29 is formed of a plurality of individual translucent stained glass panels 34 secured to flat elongated supports 32 and annular ring 33 of the first conical frame. Each panel 34 is formed of a single bright, solid color, translucent stained glass. The stained glass is cut from stock to the desired dimensions and the edges of the cut segment is polished by a suitable grinding wheel to remove all sharp edges. An external border of copper foil is then positioned around the periphery of the polished edge, with a slight overlap on both surfaces being provided, and the copper foil border is soldered in place. The individual panels 34 are provided with a slight curvature along the border thereof adapted to be positioned adjacent annular ring 33 with this curvature being essentially equal to the radius of curvature of the annular ring 33. Each copper bordered panel 34 is then individually soldered at multiple points to the elongated flat supports 32 to form the exposed surface of canopy 29. In the preferred embodiment, twelve triangular panels 34 were employed and disposed in a group sequence of three, with each sequence including a yellow, a red and a green translucent glass panel.

Picket members 43 are also disposed in a group sequence of three with each sequence including an orange and a green translucent stained glass panel and a mirror surface. The mirror surface may be a thin lightweight metal provided with a mirror surface or a glass mirror surface. In the preferred embodiment there are twenty-four picket members 43 attached to the periphery of canopy 29.

The carousel figurines 50 are also formed of translucent stained glass. Individual portions of each figurine are carefully cut to the desired dimension with the contour of the individual portions being selected to emphasize the body shape of the particular animal depicted in the figurine. These individual portions are also polished by a grinding wheel, or the like, and provided with a peripheral encasement of copper foil. The individual portions are then assembled, according to a prearranged pattern to form the character likeness intended, and soldered together to form a unitary figurine. As shown in the drawings, the Swan figurine employed in the present invention consists of a pair of two-dimensional figurines spaced apart to form a simulated seating area therebetween and is attached to a vertical support rod 52. Each rod 52 is formed of suitable brass tubing to facilitate easy connection by solder of the figurine 50 thereto. When it is desired to change the figurines, either individually or the entire cast, the solder connection is readily disrupted by heat and a different motif may be added to the carousel by changing to different character figurines. In the illustrated embodiment, five figurines are employed on carousel 10, and consist of a swan, a unicorn, a lion and a pair of horses. An additional or a less number of figurines could be employed as so desired in a specific embodiment. Figurines depicting a particular theme may also be employed such as different comic characters, a specific breed of horses, dogs, other farm or zoo animals, and the like.

Different colored stained glass portions on each of the figurines add a different perspective to the carousel. Thus, the swan illustrated is made of only black and white stained glass portions, but the other figurines include numerous shades of brown, red, blue, black, green, etc. to add a variety to the appearance of the characters. Also, although the figurines in the illustrated embodiment appear essentially two-dimensional in form, additional layers of stained glass portions are employed on the mane, tail, saddle and other areas of the figurines for emphasis and aesthetic purposes. Complete three dimensional figurines could be constructed, if so desired, and employed in the present invention.

OPERATION

The operation of the invention is now believed apparent. The power supply for the carousel 10 may be any conventional electric supply such as, for example, a normal 120 volt system. When switch S is activated Motor M, Music Box 14 and lights 40 and 41 become operational. Music box 14 may be any conventional music box such as a tape recorder, or the like, and is programmed to provide traditional carousel type music. As discussed hereinbefore, rubber tired wheel 16 on drive shaft 15 is disposed in frictional contact with the bottom surface of disk 23 of spool 22. Motor M that drives wheel 16 may be a conventional electric motor having an output of one-quarter horse power, or less. Reduction gear R serves to reduce the output of Motor M to a rate on wheel 16 such that will cause spool 22 to rotate at approximately four and one-half revolutions per minute. As spool 22 rotates in a clockwise direction, wheels 38 on the conical frame fixed to vertical shaft 19 and bearing against disk 25 of spool 22, are caused to rotate in the opposite direction. Canopy 29 has its entire weight supported on wheels 38 through annular ring 33, and being free to rotate about vertical shaft 19, then rotates in a counterclockwise direction.

In the preferred embodiment, the conical frame fixed to vertical shaft 19 is a tripod configuration with three elongated rods 36 supporting three rubber tired wheels 38. Additional elongated rods and support wheels may be employed when needed without departing from the teachings of the present invention. Also, in lieu of, or in addition to, the rubber tired wheel 16 as the drive force for spool 22, a suitable spring clutch, a ring gear arrangement or other conventional drive mechanism may be employed without departing from the present invention.

Cabinet 11 supporting carousel 10, in the preferred embodiment of the present invention, has a height of approximately forty-five inches, a width of approximately thirty inches and a length of approximately thirty-six inches. The height of the supported carousel 10 is approximately twenty-four inches and the diameter of fixed support disk 17 and spool 22 are approximately twenty-eight inches and canopy 29 has a diameter of approximately twenty-nine inches.

The weight of the assembled preferred embodiment is slightly greater than two hundred pounds. Suitable cannister wheels (not shown) are provided on cabinet 11 to facilitate moving the assembly. Also, not shown, but contemplated for use with the present invention is a plexiglass or other transparent enclosure for carousel 10 for protection from, and safety to, individuals that find it difficult to resist touching the assembly while in operation.

Although the invention has been described relative to specific embodiments, it is not so limited and there are numerous variations and modifications thereof that will be readily apparent to those skilled in the art in the light of the above teachings. It is therefore to be understood that, within the scope of the appended claims, the invention may be practiced otherwise than as specifically described.

What is claimed as new and desired to be secured by Letters Patent of the United States is:

1. A carousel comprising, in combination:

a support structure, an electric motor housed within said support structure;

a music box housed within said support structure;

said electric motor and said music box being in electrical connection with a single switch leading to a power supply;

a fixed disk in contact with and supported by said support structure;

a fixed vertical shaft integrally attached to and extending from substantially the center of said fixed disk;

a spool member rotatably supported on said vertical shaft;

said spool member including a first annular plate member spaced from said fixed disk, a vertically extending center hub having one end attached to said first annular plate and a second annular plate member attached to the other end of said vertically extending center hub, drive means connecting said electric motor to said spool member to cause rotative movement of said spool member;

a first frame rotatably supported by said vertical shaft and having a flat annular ring terminus disposed in spaced parallel relationship to said second annular plate member of said spool;

a multi-colored canopy attached to and supported by said first frame;

a second frame fixed to said vertical shaft and disposed between said first frame and said second annular plate member of said spool;

said second frame having a tripod configuration and having an axle structure disposed on each of its ends, a rotatable wheel member having a rubber tire mounted thereon disposed on each said axle; each said rubber tire resting on said second annular plate member of said spool, said flat annular ring terminus being a frictional contact with and resting on said rubber tires;

a plurality of carousel figurines circumferentially disposed about the vertically extending center hub and between said annular plate members of said spool member;

means for imparting individual vertical reciprocating movement to said carousel figurines as said spool member rotates;

whereby, when said switch is activated, carousel music will emanate from said music box, said spool member will rotate in a first direction, said first frame and the attached canopy will rotate in a direction opposite to that of said spool member, and as said spool member rotates, the carousel figurines carried thereby will individually undergo vertical reciprocating movement.

2. A carousel comprising, in combination:

a support structure, a fixed disk in contact with and supported by said support structure, a fixed hollow vertical shaft integrally attached to and extending from substantially the center of said fixed disk;

a spool member rotatably supported on said vertical shaft;

means for rotating said spool member in a first direction;

a plurality of carousel figurines circumferentially disposed on said spool member;

means for causing said carousel figurines to individually execute vertical reciprocating movement as said spool member rotates;

a first frame rotatably supported by said vertical shaft and having a fixed annular ring terminus disposed in spaced relationship to said spool member;

a second frame fixed to said vertical shaft and disposed between said first frame and said spool member;

said second frame terminating in a plurality of individual elongated rods;

an axle assembly carried by each said elongated rod;

a wheel mounted on each said axle assembly;

a rubber tire mounted on each said wheel and being in frictional contact with said spool member and said fixed annular ring terminus of said first frame; and, a multi-colored covering for said first frame means;

whereby, when said spool member is rotated in a first direction, the rubber tire covered wheels will rotate with the frictional engagement therewith of the annular terminus of said first frame causing said first frame means to rotate in a second direction opposite to the rotation of said spool member.

3. A carousel comprising:

a fixed support disk;

a hollow vertical shaft extending through and fixed to said fixed support disk;

a drum member disposed on said vertical shaft and secured to said fixed support disk;

a spool member rotatably disposed on said vertical shaft and supported by said drum;

a substantially conical multi-colored canopy rotatably diposed on said hollow vertical shaft in spaced relationship with said spool;

a plurality of carousel figurines disposed in spaced circumferential relationship on said spool member;

means for rotating said spool member in a first direction;

means to cause said carousel figurines to individually execute vertical reciprocating movement as said spool is rotated; and, means for rotating said canopy in a direction opposite to the rotation of said spool member.

4. The carousel of claim 3 wherein said spool member comprises a pair of disk elements of substantially the same size as said support disk and a central vertical elongated hub member connected to said pair of disks and circumferentially encompassing a length of said vertical shaft.

5. The carousel of claim 3 wherein said substantially conical multi-colored canopy is supported on a frame, said frame including a hub rotatably disposed about said vertical shaft, a plurality of elongated elements depending from said hub and an annular ring terminus connected to said elongated elements and positioned substantially parallel with and spaced from said spool member.

6. The carousel of claim 3 wherein said means causing said carousel figurines to individually execute vertical reciprocating movement as said spool member rotates includes each said plurality of carousel figurines being attached to individual vertically extending sliding rod supports, each sliding rod support slidably extending through the bottom and top ends of said spool member, the end of each rod support extending through the bottom of said spool member terminating in a fitting provided with a bifurcated end and having an axle extending therethrough, a wheel having a rubber tire thereon rotatably disposed on each said axle, an undulating track surface disposed on said support disk and aligned with the position of said sliding rod supports; whereby, as said spool rotates, the rubber tire on each said sliding rod support traverses said undulating track surface and causes said sliding rod support and the attached carousel figurine thereon to undergo individual vertical reciprocating movement.

7. The carousel of claim 6 including means for preventing rotation of each said individual sliding rod support during the vertical reciprocating movement thereof to thereby insure that each said wheel maintains a constant course along said undulating track.

8. The carousel of claim 7 wherein said means for preventing rotation of each said sliding rod support includes a detent pin fixed to the sliding rod support end that extends through the top end of said spool member, said detent pin extending transversely from said rod support, a channeled bracket disposed in fixed parallel relationship to said support rod, said channeled bracket slidably receiving said detent pin and preventing rotative movement of said detent pin and the attached support rod while freely permitting relative vertical sliding movement by said detent pin as said support rod undergoes vertical reciprocating movement.

9. The carousel of claim 3 wherein said means for rotating said spool member includes an electric motor, a reduction gear connected to said electric motor, an output shaft extending from said reduction gear, a wheel having a rubber tire mounted thereon secured to and rotated by said output shaft, said rubber tire being in frictional contact with said spool member and serving to cause said spool member to rotate as said wheel is turned by said output shaft.

10. The carousel of claim 3 wherein said means for rotating said canopy in an opposite direction to the rotation of said spool member includes a first conical frame having a hub rotatably disposed on said vertical shaft in spaced relationship with said spool member, said first conical frame having a plurality of spaced elongated members extending from said hub and terminating in an annular ring disposed in parallel spaced relationship with said spool member, a second conical frame having a hub fixed to said hollow vertical shaft and having a plurality of elongated rod members extending therefrom, each said elongated rod terminating in an axle segment parallel to said annular ring and said spool member, a rotatable wheel mounted on each said axle, a rubber tire mounted on each said wheel, each said rubber tire being in frictional contact with said spool member and said annular ring of said first conical frame member whereby, when said spool rotates in a first direction, each said rubber tire in contact therewith will rotate in the opposite direction and the frictional engagement with said annular ring on said first conical frame will cause said canopy to rotate in a direction opposite to the direction of said spool member rotation.

11. The carousel of claim 3 wherein said multi-colored canopy includes a hub rotatably disposed on said vertical shaft and having a frame formed of elongated elements, said elongated elements having one end connected to said hub and the other end thereof attached to an annular ring disposed in spaced parallel relationship with said spool member, a plurality of stained glass panels supported by and attached to said elongated elements, said stained glass panels having an arcuate base and a pair of sides tapering from said arcuate base to a point adjacent to said hub.

12. The carousel of claim 3 wherein said multi-colored canopy includes a plurality of translucent stained glass panels, and including a substantially spherical, multi-facet, reflective surface member attached to the apex of, and adapted to rotate with, said canopy.

13. The carousel of claim 12 including a conical frame having a hub rotatably disposed on said vertical shaft in spaced relationship with said spool member, said conical frame having a plurality of spaced elongated members extending from said hub and terminating in an annular ring disposed in spaced parallel relationship with said spool member, said plurality of translucent stained glass panels being supported by and secured to said spaced elongated members of said conical frame, each said translucent stained glass panel having an arcuate base of essentially the same radius of curvature as said annular ring and a pair of tapered sides tapering from said arcuate base to a point adjacent said hub.

14. The carousel of claim 13 including a plurality of picket members secured about the circumference of said canopy in adjacent relationship to and of adequate height to span the spaced area between said spool and said annular ring, said picket members being formed of materials selected from the group of materials consisting of translucent stained glass and mirror surfaces.

15. The carousel of claim 14 wherein the number of picket members formed of stained glass are twice the number of mirror picket members, each said stained glass picket member being formed of a single color and including said picket members being circumferentially arranged in a sequence of three, each sequence consisting of a mirror picket surface, a stained glass formed of a first color, and a stained glass formed of a second color.

16. The carousel of claim 3 wherein said spool member includes an elongated central hub and a top and a bottom disk secured to said elongated central hub, said elongated central hub having a circumferential multi-faceted mirror surface, said mirror surface being formed of a plurality of flat mirrored segments disposed in vertical relationship about the circumference of said elongated hub.

17. The carousel of claim 16 including a plurality of electric lights carried by said spool member and positioned such that the light from at least some of said plurality of lights is reflected by said multi-faceted mirror surface on said elongated central hub.

18. The carousel of claim 17 including at least some of said electric lights being disposed on said spool member such that the light therefrom is directed beneath said multi-colored canopy and wherein at least part of said canopy is formed of translucent stained glass.

19. The carousel of claim 18 wherein said translucent stained glass comprises a plurality of stained glass panels formed of essentially equal size, elongated, triangular configured panels.

20. The carousel of claim 19 including a plurality of vertically extending picket members secured about the circumference of said canopy, at least some of said picket members being formed of translucent stained glass and at least some of said plurality of lights transmitting light to said picket members.

* * * * *